US007290305B1

(12) United States Patent
Auchmoody

(10) Patent No.: US 7,290,305 B1
(45) Date of Patent: Nov. 6, 2007

(54) MOP WITH CLEANING PAD INSERTION TOOL

(76) Inventor: Doreen M. Auchmoody, 150 Kingston Ave., Port Jervis, NY (US) 12771

( * ) Notice: Subject to any disclaimer, the term of this patent is extended or adjusted under 35 U.S.C. 154(b) by 670 days.

(21) Appl. No.: 10/657,042

(22) Filed: Sep. 5, 2003

(51) Int. Cl.
*A47L 13/20* (2006.01)

(52) U.S. Cl. ..... 15/231; 15/228; 15/257.01; 81/488; 81/436; 29/270

(58) Field of Classification Search ..... 15/231, 15/228, 257.01; 81/488, 436; 29/270
See application file for complete search history.

(56) References Cited

U.S. PATENT DOCUMENTS

| | | | | |
|---|---|---|---|---|
| 2,339,187 | A | 1/1944 | Pain | |
| 3,099,855 | A | 8/1963 | Nash | |
| 3,877,103 | A | 4/1975 | Nash | |
| 4,712,268 | A | 12/1987 | Heinonen | |
| 4,971,471 | A | 11/1990 | Sloan | |
| 5,323,507 | A | 6/1994 | Tosato | |
| 5,425,695 | A * | 6/1995 | Ridgley | 493/373 |
| 5,915,437 | A | 6/1999 | Petner | |
| 6,098,239 | A | 8/2000 | Vosbikian | |
| 6,202,250 | B1 | 3/2001 | Kenmochi et al. | |
| 6,217,072 | B1 * | 4/2001 | Gregg | 280/823 |
| 6,295,688 | B1 * | 10/2001 | Sayles et al. | 15/210.1 |
| 6,305,046 | B1 | 10/2001 | Kingry et al. | |
| 6,539,965 | B1 * | 4/2003 | White, III | 135/66 |
| 2004/0020524 | A1 * | 2/2004 | McConnell | 135/66 |

* cited by examiner

*Primary Examiner*—Gary K. Graham

(57) ABSTRACT

A cleaning pad insertion tool for facilitating coupling of disposable cleaning wipes onto a head of an electrostatic mop by inserting a portion of the disposable cleaning wipe into a grip assembly of the electrostatic mop, and method of use therefore. The cleaning pad insertion tool includes an elongate member adapted for pressing a portion of a disposable cleaning wipe into at least one grip assembly on a head of an electrostatic mop; a clip portion operationally couplable to a handle of the electrostatic mop for selectively receiving the elongate member when not in use; and a tether member couplable to the elongate member and the a handle of the electrostatic mop for inhibiting loss of the elongate member.

8 Claims, 2 Drawing Sheets

MOP WITH CLEANING PAD INSERTION TOOL

BACKGROUND OF THE INVENTION

1. Field of the Invention

The present invention relates to electrostatic mops and more particularly pertains to a new cleaning pad insertion tool for facilitating coupling of disposable cleaning wipes onto a head of an electrostatic mop by inserting a portion of the disposable cleaning wipe into a grip assembly of the electrostatic mop.

2. Description of the Prior Art

The use of electrostatic mops is known in the prior art. More specifically, electrostatic mops heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,202,250; U.S. Pat. No. 5,915,437; U.S. Pat. No. 6,305,046; U.S. Pat. No. 2,339,187; U.S. Pat. No. 6,098,239; U.S. Pat. No. 5,323,507; U.S. Pat. No. 4,971,471; U.S. Pat. No. 4,712,268; U.S. Pat. No. 3,877,103; and U.S. Pat. No. 3,099,855.

SUMMARY OF THE INVENTION

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a insertion tool and method which has many of the advantages of the insertion assistance devices mentioned heretofore and many novel features that result in insertion tool which is not anticipated, rendered obvious, suggested, or even implied by any of the prior art insertion assistance devices, either alone or in any combination thereof.

It is another object of the present invention to provide a new insertion tool which may be easily and efficiently manufactured and marketed.

It is a further object of the present invention to provide a new insertion tool which is of a durable and reliable construction.

An even further object of the present invention is to provide a insertion tool which is susceptible of a low cost of manufacture with regard to both materials and labor, and which accordingly is then susceptible of low prices of sale to the consuming public, thereby making such insertion tool economically available to the buying public.

Still yet another object of the present invention is to provide a insertion tool which provides in the apparatuses and methods of the prior art some of the advantages thereof, while simultaneously overcoming some of the disadvantages normally associated therewith.

Another object of the present invention is to provide a new cleaning pad insertion tool that protects the fingers and nails of a user by providing a tool to insert a cleaning wipe into a grip assembly of an electrostatic mop.

Still another object of the present invention is to provide a new cleaning pad insertion tool that insures proper contact of a cleaning wipe with a grip assembly of an electrostatic mop.

Yet another object of the present invention is to provide a securing means for storing the tool when not in use.

Even still another object of the present invention is to provide a tether member having enough length to allow the tool to reach each of the grip assemblies while coupling the tool to the electrostatic mop to prevent loss.

To this end, the present invention generally comprises an elongate member adapted for pressing a portion of a disposable cleaning wipe into at least one grip assembly on a head of an electrostatic mop; a clip portion operationally couplable to a handle of the electrostatic mop for selectively receiving the elongate member when not in use; and a tether member couplable to the elongate member and the handle of the electrostatic mop for inhibiting loss of the elongate member.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
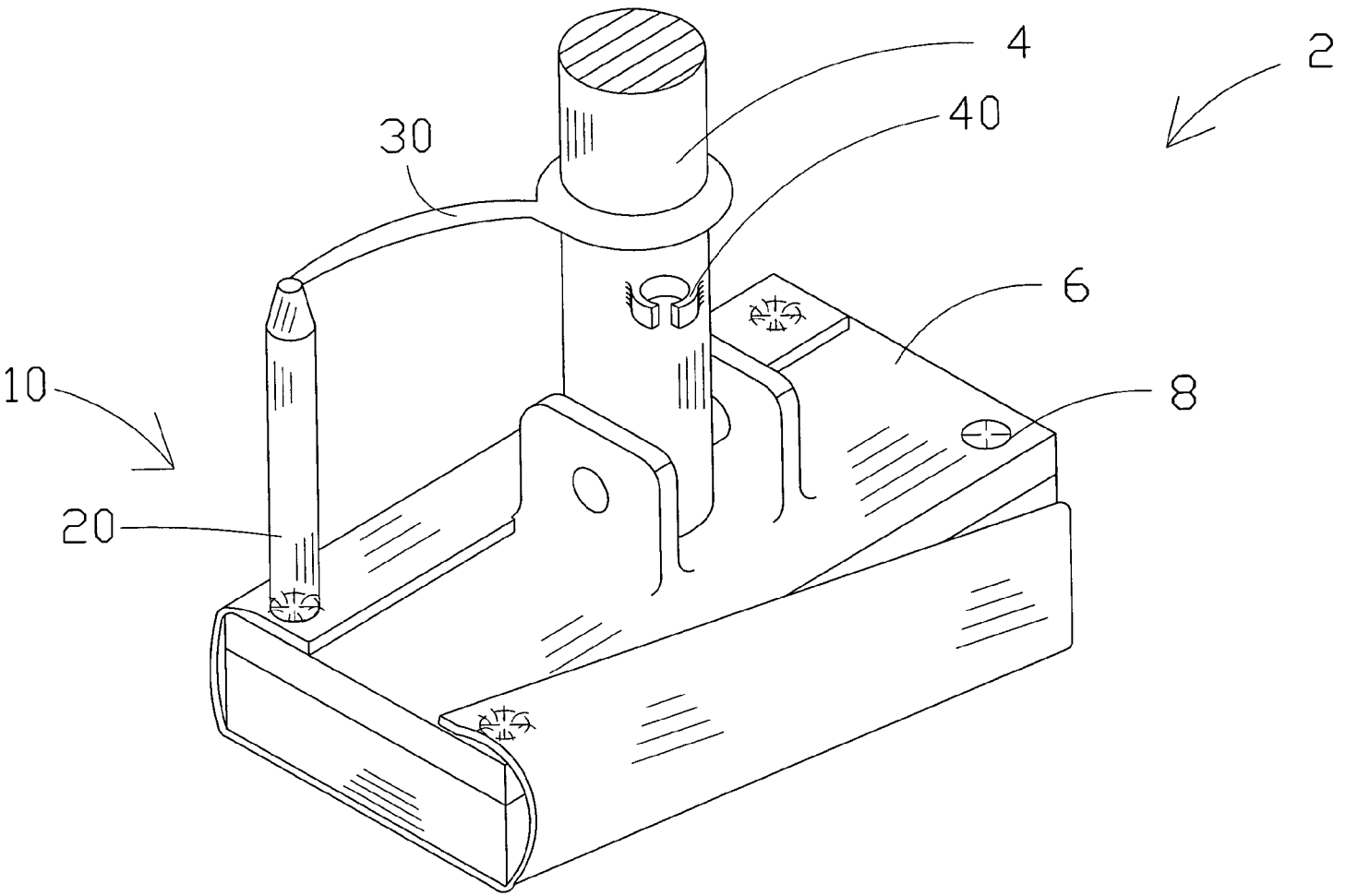
FIG. 1 is a schematic perspective view of a new cleaning pad insertion tool according to the present invention.
Figure 2:
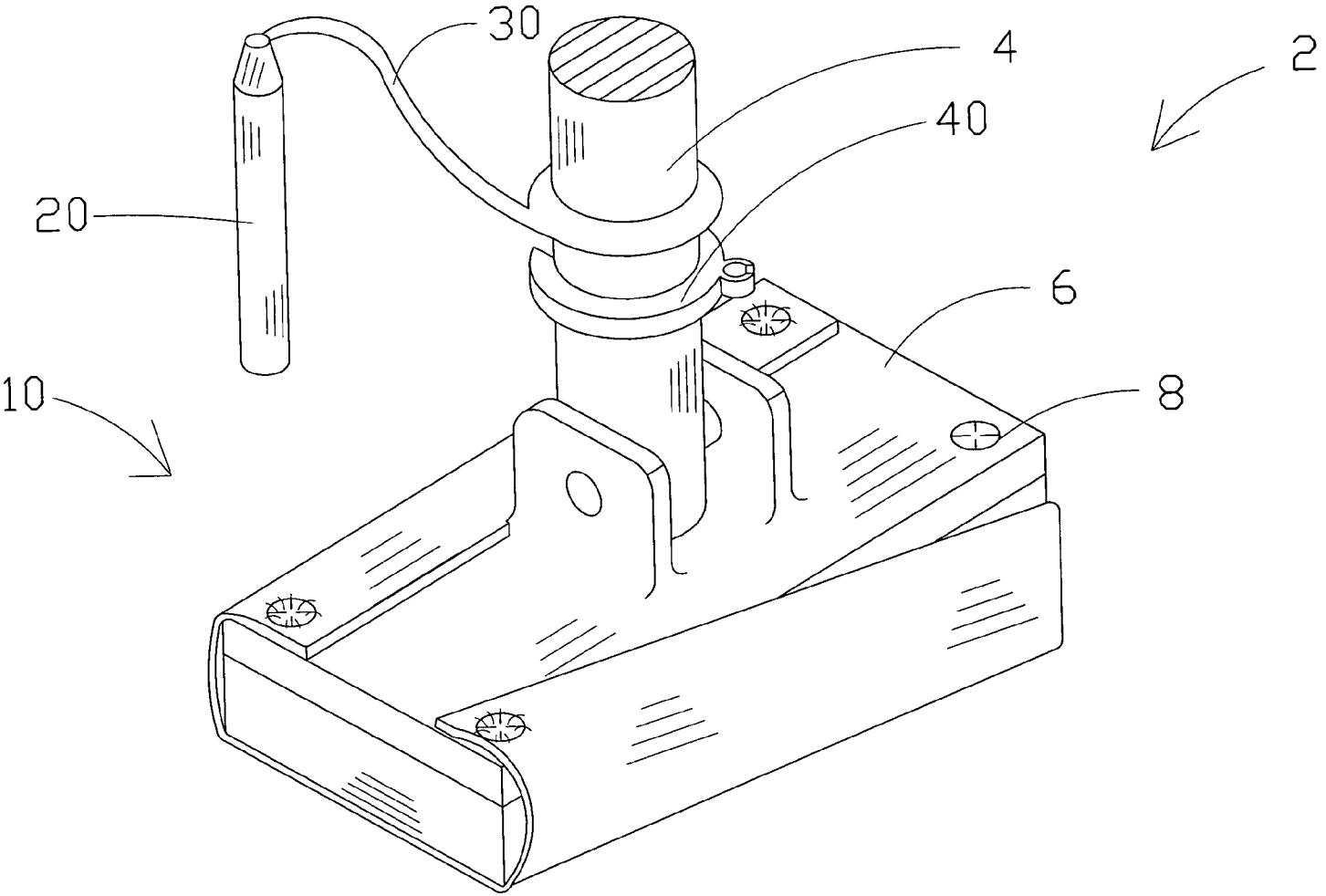
FIG. 2 is a schematic perspective view of and embodiment of the present invention.

With reference now to the drawings, and in particular to FIGS. 1 and 2 thereof, a new cleaning pad insertion tool embodying the principles and concepts of the present invention and generally designated by the reference numeral 10 will be described.

As best illustrated in FIGS. 1 and 2, the cleaning pad insertion tool 10 generally comprises an elongate member 20, a tether member 30 and a clip portion 40.

In a preferred embodiment, the clip portion 40 is integrally forming into a lower portion of the handle 4 of an electrostatic mop 2. The clip portion 40 selectively retains the elongate member 20, when the elongate member 20 is not in use. The tether member 30 is coupled to both the handle portion 4 of the electrostatic mop 2 and the elongate member 20 to inhibit losing the elongate member 20. Most preferably, the tether member 30 has enough length to permit the easy use of the elongate member 20 at each of the grip assemblies 8 on the head 6 of the electrostatic mop 2, but is short enough to avoid dragging on the floor when the elongate member 20 is retained by the clip portion 40.

The present invention also contemplates an embodiment wherein the elongate member 20, the clip portion 40 and the tether member 30 are provided as aftermarket accessories to conventional electrostatic mops 2. In this embodiment, the tether member 30, and the elongate member 20 remain substantially unchanged. The clip portion 40 is designed to coupled to an existing handle 4 of a conventional electrostatic mop 2.

In use, the disposable cleaning wipe is positioned onto the head portion of the electrostatic mop with a portion of the disposable cleaning wipe overlapping each one of the grip assemblies on the head portion. The user grips the second end of the elongate member in a hand. The user then positions the first end of the elongate member on a portion of the disposable cleaning wipe abutting a grip assembly. The user next presses the portion of the disposable cleaning wipe into the grip assembly using the first end. The user then repeats the steps of positioning the first end and pressing a portion of the disposable cloth using the first end until each portion of the disposable cleaning wipe abutting a grip assembly has been secured. After use, the user then placed the elongate member into the clip portion for storage until needed for the next disposable cleaning wipe.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a mop comprising:

a handle portion;

a head portion mounted on the handle portion at one end thereof, the head portion including at least one gripping assembly;

a disposable cleaning wipe removably mounted on said head portion, said disposable cleaning wipe being at least partially wrapped about said head portion; and an insertion tool for pressing a portion of said disposable cleaning wipe into said at least one grip assembly on said head portion of said mop, said insertion tool comprising:

an elongate member having a first end and a second end, said first end being configured to insert into said at least one gripping assembly to removably secure said disposable cleaning wipe in said at least one gripping assembly;

a tether member securing said elongate member to said handle portion to inhibit loss of said elongate member; and a clip member for removably coupling said elongate member to said handle potion of said mop.

2. The combination of claim 1 wherein said at least one gripping assembly comprises at least one recess formed in said head portion.

3. The combination of claim 2 wherein said at least one gripping assembly comprises four recesses formed in said head portion.

4. The combination of claim 1 wherein said tether member has a first end and a second end, said first end of said tether member being fixed to said elongate member, said second end of said tether member being coupled to said handle portion of said mop, said tether member having a length sufficient for said elongate member to be used to insert a portion of the disposable cleaning wipe into each grip assembly on said head portion of said mop.

5. The combination of claim 4 wherein said second end of said tether member defines a loop receiving the section of said handle portion.

6. The combination of claim 1 wherein said clip member is configured to removably receive a section of said handle portion and a section of said elongate member.

7. The combination of claim 1 wherein said clip member comprises a first C-shaped portion for receiving the section of said handle portion and a second C-shaped portion for selectively receiving the section of said elongate member to hold said elongate member on said handle portion when said elongate member is not being used.

8. The combination of claim 1 wherein said at least one gripping assembly comprises at least one recess formed in said head portion;

wherein said at least one gripping assembly comprises four recesses formed in said head portion;

wherein said tether member has a first end and a second end, said first end of said tether member being fixed to said elongate member, said second end of said tether member being coupled to said handle portion of said mop, said tether member having a length sufficient for said elongate member to be used to insert a portion of the disposable cleaning wipe into each grip assembly on said head portion of said mop;

wherein said second end of said tether member defines a loop receiving the section of said handle portion;

wherein said clip member is configured to removably receive a section of said handle portion and a section of said elongate member; and wherein said clip member comprises a first C-shaped portion for receiving the section of said handle portion and a second C-shaped portion for selectively receiving the section of said elongate member to hold said elongate member on said handle portion when said elongate member is not being used.

* * * * *